US007922168B2

(12) United States Patent
Schluenss

(10) Patent No.: US 7,922,168 B2
(45) Date of Patent: Apr. 12, 2011

(54) METHOD AND DEVICE FOR TRANSPORTING A SHEET

(75) Inventor: Stefan Schluenss, Schacht-Audorf (DE)

(73) Assignee: Eastman Kodak Company, Rochester, NY (US)

( * ) Notice: Subject to any disclaimer, the term of this patent is extended or adjusted under 35 U.S.C. 154(b) by 561 days.

(21) Appl. No.: 12/063,479

(22) PCT Filed: Aug. 4, 2006

(86) PCT No.: PCT/EP2006/007735

§ 371 (c)(1),
(2), (4) Date: Feb. 11, 2008

(87) PCT Pub. No.: WO2007/017193

PCT Pub. Date: Feb. 15, 2007

(65) Prior Publication Data

US 2010/0164167 A1 Jul. 1, 2010

(30) Foreign Application Priority Data

Aug. 11, 2005 (DE) ..... 10 2005 038 321

(51) Int. Cl.
*B65H 5/00* (2006.01)

(52) U.S. Cl. ..... 271/10.02; 271/10.03; 271/270

(58) Field of Classification Search ..... 271/270, 271/202, 10.02, 10.03
See application file for complete search history.

(56) References Cited

U.S. PATENT DOCUMENTS

| | | | | |
|---|---|---|---|---|
| 6,792,332 | B1 * | 9/2004 | DePoi | 700/213 |
| 6,893,175 | B2 * | 5/2005 | Sussmeier et al. | 400/608.4 |
| 7,240,901 | B2 * | 7/2007 | Matsumoto et al. | 271/270 |
| 2003/0201600 | A1 * | 10/2003 | Hayashi | 271/270 |
| 2004/0227283 | A1 * | 11/2004 | Hanada et al. | 271/270 |
| 2004/0230336 | A1 * | 11/2004 | Matsumoto et al. | 700/223 |
| 2006/0202411 | A1 * | 9/2006 | Yasui et al. | 271/270 |
| 2007/0194521 | A1 * | 8/2007 | Matsumoto et al. | 271/270 |

FOREIGN PATENT DOCUMENTS

| | | |
|---|---|---|
| EP | 1 403 201 | 3/2004 |
| GB | 2 259 501 | 3/1993 |
| JP | 10 231035 | 9/1998 |

* cited by examiner

*Primary Examiner* — David H Bollinger
(74) *Attorney, Agent, or Firm* — David A. Novais; Eugene I. Shkurko

(57) ABSTRACT

The invention relates to a method and a device for transporting a sheet, in particular after a sheet has been picked off a stack and separated therefrom, preferably for the feeder-side use in a printing machine, wherein the sheet is brought to a transport speed, preferably for transfer to another transport path. The object of the invention is to provide a more controlled method of the aforementioned type and a device allowing this method. In accordance with the invention, considering the method, this object is achieved in that the sheet is initially accelerated to a speed that is greater than the desired transport speed and only later, after a phase of this higher speed, said sheet is slowed to the desired transport speed, in which case the phase of the higher speed is dimensioned such that the affected sheet is in a nominal position at the appropriate time.

13 Claims, 2 Drawing Sheets

METHOD AND DEVICE FOR TRANSPORTING A SHEET

Figure 1:
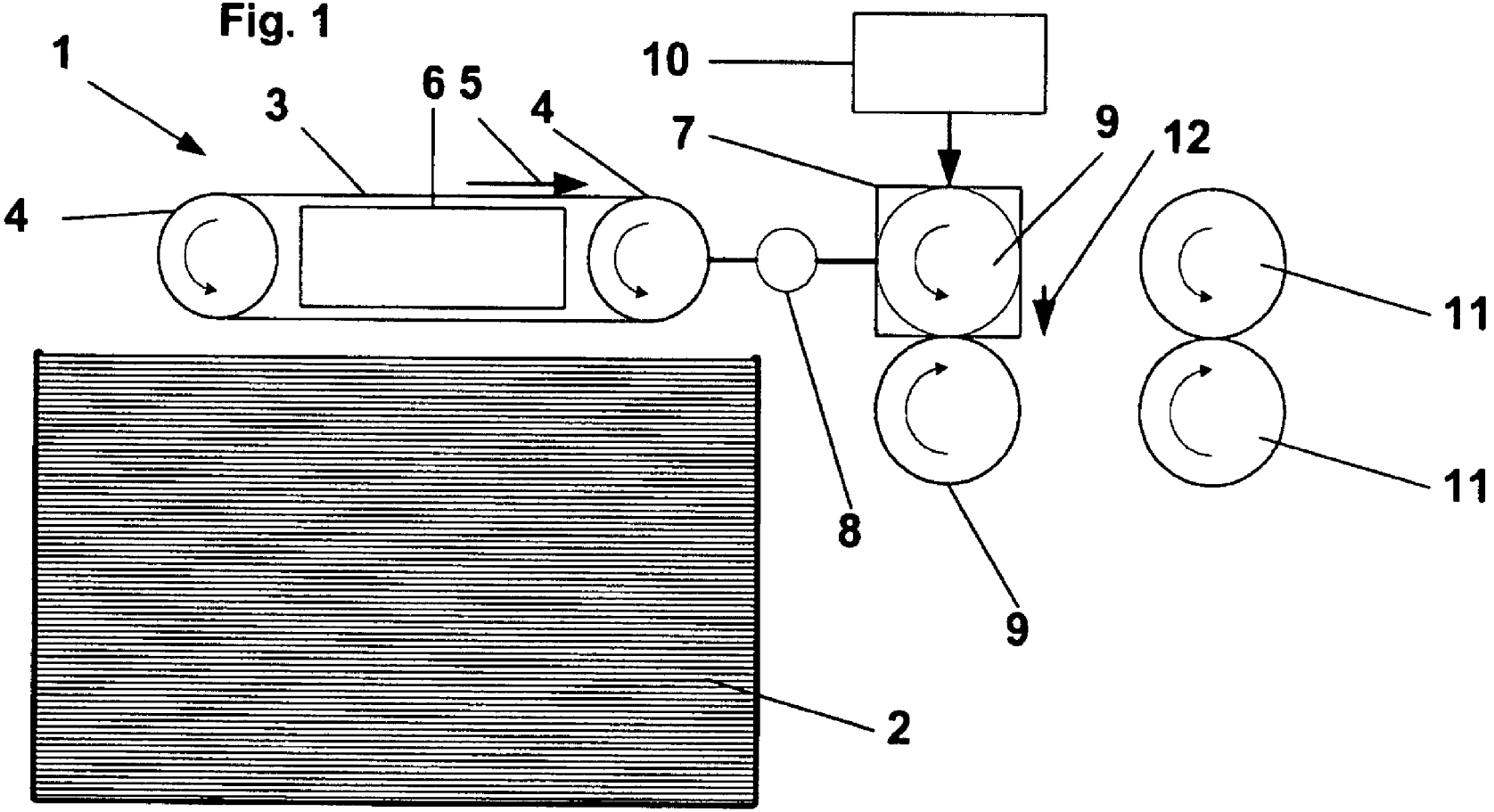

The invention relates to a method of transporting a sheet, in particular after a sheet has been picked off a stack and separated therefrom, preferably for the feeder-side use in a printing machine, wherein the sheet is brought to a transport speed, preferably for transfer to another transport path.

Further, the invention relates to a device for transporting a sheet, in particular for picking a sheet off a stack and separating it from said stack, preferably for the feeder-side arrangement in a printing machine, comprising at least one transport element in order to bring the sheet to a transport speed for carrying out the aforementioned method.

A method and a device of the aforementioned types have basically been known from DE 196 07 826 A1 that corresponds to U.S. Pat. No. 5,634,634 A. In particular, these disclose (see DE 196 07 826 A1, column 10, lines 22 through 60) the connection of a motor with a set of rolls by selectively actuating a clutch in such a manner that the transport belts are driven so that a grasped sheet is transported away from a stack of sheets and then is ready for further processing. The grasped sheet may have a position deviating from the desired position, this being critical specifically in electrophotographic printing of a sheet, in particular, however, also in any other way of printing of the sheet, because an exactly registered application of a printed image to the sheet requires that it be fed to a printing unit in a time-appropriate and/or location-appropriate manner. For example, the position error of the sheet can be due to the fact that said sheet has been deposited in an improper or inaccurate manner, or due to the fact that said sheet's pick-up and transport is affected in situations of poor paper quality, waves of the sheet, electrostatic charging of the sheet or a jolt-like motion caused by a clutching operation as in this cited prior art.

Therefore, the object of the invention is to provide a more controlled method of the aforementioned type and a device allowing this method, in particular, also in view of a possible position correction of the sheet.

In accordance with the invention, considering the method, this object is achieved in that the sheet is initially accelerated to a speed that is greater than the desired transport speed and only later, after a phase of this higher speed, said sheet is slowed to the desired transport speed, in which case the phase of the higher speed is dimensioned such that the affected sheet is in a nominal position at the appropriate time. If needed, of course, the sheet could be slowed directly to the transport speed, i.e., not from the higher speed, but said sheet could initially be decelerated to an even slower speed than the transport speed and, only after a certain time, be brought to transport speed, because otherwise the sheet moves too far ahead of its desired position.

Therefore, the inventive method advantageously ensures that, depending on whether a sheet lags behind a desired position, is in an exact position or is ahead of a desired position, said sheet is provided for an appropriately shorter or longer phase, said phase being adjustable as to time and/or space, with a higher speed than the transport speed, i.e., individually only long enough, so that, during the continued transport, each sheet has or has achieved its or the specified nominal position. Therefore, in accordance with the invention, initially existing in-track (in transport direction) position errors are corrected in an elegant manner.

This is particularly successful for a particularly gentle and controlled transport of the respective sheet, in particular when a stepper motor is used with a preferred embodiment of the inventive device in order to avoid a (jerky) engagement and disengagement of the clutch.

Also, the progression of acceleration or deceleration plays a part in achieving a problem-free acceleration of the sheet during the acceleration phase. A further modification of the invention provides particularly advantageously that the progression of acceleration takes place as a function of time (t), essentially a function $\sin^x t$, where the exponent x is a number greater than or equal to 1 though smaller than or equal to 4. Preferably, the exponent x is approximately equal to 2.

Preferably, the progression of speed is electronically controlled. To achieve this, the progression of acceleration is preferably stored in an electronic control system.

A further modification of the inventive method provides that, in order to detect the position of the sheet's lead edge, a lead edge sensor is provided and that, using this detection, the position of the sheet—taking into consideration the later desired nominal position to be reached by the sheet at the proper time and at the proper location—is compared with a pre-specified desired position, and that this comparison is used to determine the length of the phase of higher speed.

Preferably, this actual position of the sheet is detected during the phase of higher speed, which, depending on the result of this determination, is interrupted more or less rapidly in order to bring the sheet to its actual transport speed.

Furthermore, protection is claimed for an inventive device for transporting a sheet, in particular for picking a sheet off a stack and separating it from said stack, preferably for the feeder-side arrangement in a printing machine, comprising at least one transport element in order to bring the sheet to a transport speed for carrying out the aforementioned method, said device achieving the object of the invention and being characterized in that the transport element can be driven in such a manner that the sheet can initially be accelerated to a speed that is greater than the desired transport speed and only later, after a phase of this higher speed, said sheet can be slowed to the desired transport speed, in which case the phase of the higher speed can be dimensioned such that the affected sheet is in a nominal position at the appropriate time.

The resultant advantages have already been basically explained in conjunction with the inventive method.

For the gentle and continuous movement, specifically also the acceleration of a sheet, preferably for picking this sheet off a stack, the inventive device preferably comprises a (picker) motor that drives the transport element. Preferably, the picker motor is a high-performance stepper motor which specifically makes any engagement and disengagement unnecessary because this motor can be accelerated and decelerated in a controlled manner.

In a preferred embodiment of the inventive device, a path segment is provided between the feed rolls of the motor, and the closest subsequent transport rolls on the transport path for completion of the phase at the higher speed. This path segment or this distance may, for example, measure approximately 10 centimeters.

For example, the actual position of the sheet can be detected with the aid of a lead edge sensor that is known per se, i.e., optimally at the output of the feed rolls of the motor, i.e., at the start of the said path segment.

Embodiments which can result in additional inventive features, to which, however, the scope of the invention is not restricted, are shown by schematic drawings.

They show in:

FIG. 1 a side elevation of an inventive device, and

Figure 2:
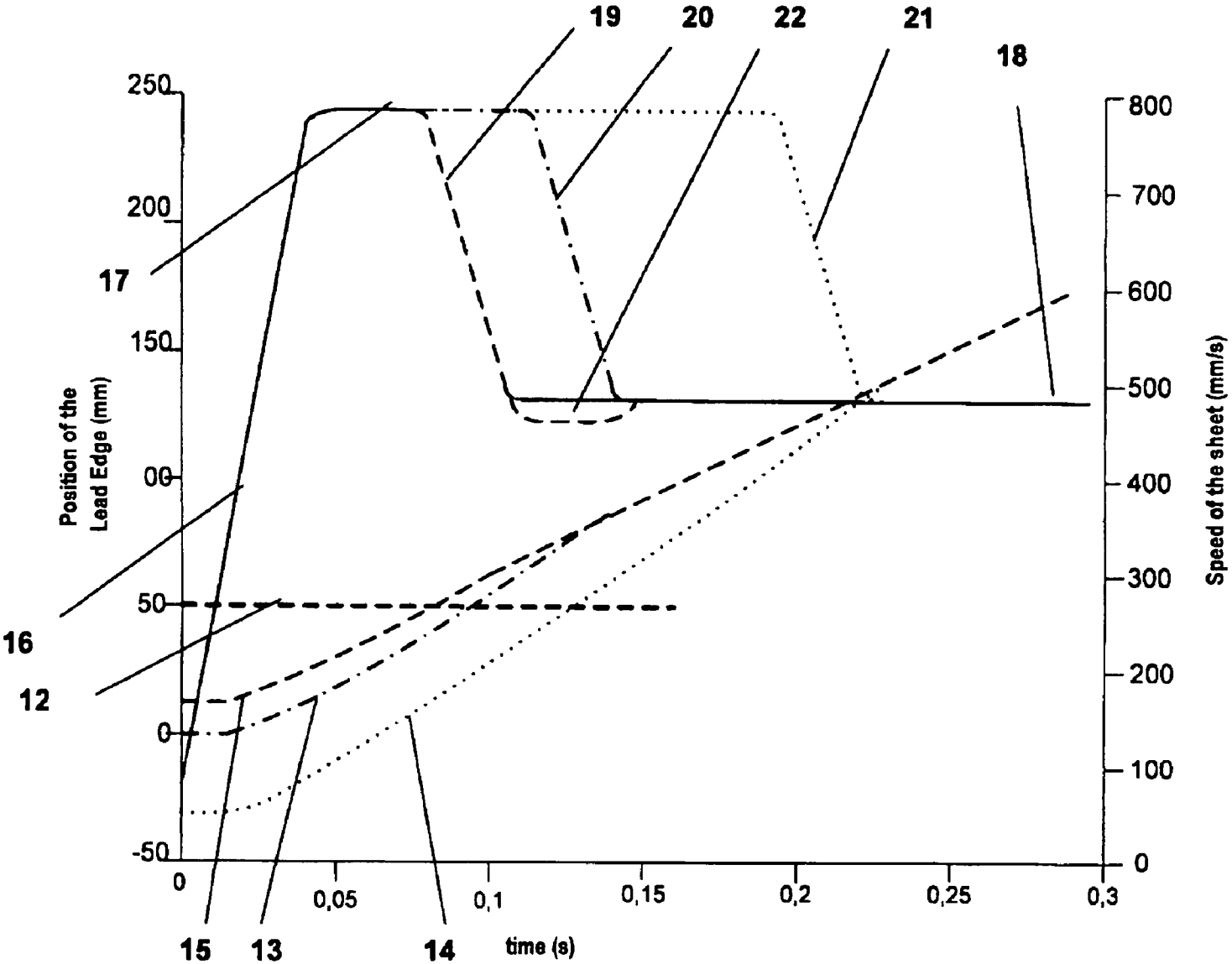

FIG. 2 velocity and motion profiles of the progression of the inventive method, each as a function of time (t).

FIG. 1 shows a side elevation of an inventive device in a rough and highly schematic drawing.

The device comprises a separating device 1 for picking a sheet off a stack 2 and for separating said sheet from said stack, and for a first transport of the separated sheet into an (additional) transport path. Separating device 1 comprises a transport belt essentially configured as a suction web that is looped around drive rolls 4 and is provided for grasping a sheet picked off stack 2 and for transporting said sheet in the direction of an arrow 5, and comprises a suction chamber 6 for aspirating a sheet to transport belt 3 and for holding said sheet during transport by transport belt 3.

By means of clutch 8, at least one of the drive rolls 4 is permanently connected with a motor 7, which also drives a first pair of transport rolls or its feed rolls 9 as the start of a transport path following separating device 1. This motor 7 is a high-performance stepper motor actuated by means of an electronic control system 10. With the use of this electronic control system 10, motor 7 can be actuated and operated based on a pre-specified velocity profile. In conjunction with FIG. 2, this will be explained in detail Viewed in transport direction 5 of the sheet, another pair of transport rolls 11, to which the sheet may be transferred, follows a pair of transport rolls 9. Other than that, the continuation of the transport path is not illustrated in detail. For the transfer of the sheet from transport rolls 9 to transport rolls 11, viewed in the direction of an arrow 12, a lead edge sensor is provided for detecting a sheet, said sensor being also optionally connected with electronic control system 10, in order to detect for said system an arrival time of the sheet's lead edge. As soon as a sheet has been detected at point 12, the path segment between this point 12 and the nip of the pair of rollers 11 remains available for a potential inventive position correction of said sheet by means of a controlled velocity and acceleration profile imparted by motor 7 to said sheet.

FIG. 2 again shows or illustrates, only basically and schematically and qualitatively and not so much quantitatively, a velocity and motion profile for performing the inventive method in coordinate systems, each as a function of time (t).

FIG. 2 shows two coordinate systems having different ordinates and having the same abscissa. Time (t) in seconds is plotted on the abscissa.

The position of the sheet's lead edge is plotted in millimeters on the left ordinate, i.e., related to a reference position "0", for example, at distance of +50 millimeters from lead edge sensor 12 of FIG. 1, this being marked by a dashed horizontal line 12 at this location in FIG. 2.

The velocity of the sheet in millimeters per second is plotted on the right ordinate, as it is imparted to the sheet by motor 7 as a function of time (t).

FIG. 2 shows examples of three basically possible situations of a sheet position. A possible sheet, illustrated by a chain line 13, is exactly in the desired position. Its line 13 intersects the left ordinate at zero. Another possible sheet, illustrated by dotted line 14, lags behind the desired position. Thus, its line 14 bisects the left ordinate, for example, at approximately minus 30, i.e. it is approximately 30 millimeters behind the desired position; hence, it has not advanced far enough into transport direction. Another possible sheet, illustrated by a dashed line 15, is already ahead of the desired position. Thus, its line 15 bisects the left ordinate, for example, at plus 15, i.e., it is already 15 millimeters ahead of the desired position, and hence it has advanced too far in transport direction.

These three examples of possible sheets 13, 14, 15 are initially accelerated in the same way with the aid of motor 7 as shown by a solid velocity line 16, said line, of course, relating to the right ordinate, and thus said sheets equally reach a speed that is greater than the actual transport speed as illustrated by a solid (constant) velocity line 17 at a speed of approximately 775 millimeters per second.

Considering this high speed, the three sheets 13, 14, 15, due to their different starting positions, reach lead edge sensor 12 at different times, namely, for example, in a time of 0.08 seconds, 0.09 seconds and 0.125 seconds, respectively. However, in the continued progression of the transport, all three sheets 13, 14, 15 should reach the same nominal position at the same (relative) time; for example, at an approximate time of 0.22 seconds, this nominal position should be approximately plus 112 millimeters. In FIG. 2, the point that has been chosen for this example is where the dashed line 15 and the dotted line 14 finally meet. In order to achieve this, the positions of sheets 13, 14, 15 must be differently corrected as needed. This is achieved in that the sheets 13, 14, 15 are kept different lengths of time at the higher speed 17 and are brought with different delays to the transport speed, which, for example, is at approximately 480 millimeters per second and is illustrated by a solid (constant) line 18. The different earlier or later reductions of the speed are illustrated by lines 19, 20, 21. In particular, considering the far advance sheet 15, 19, the speed could initially be even reduced to a speed 22 below transport speed 18 in order to delay said sheet and correct its position.

The invention claimed is:

1. Method of transporting a sheet, after a sheet has been picked off a stack and separated therefrom, for feeder-side use in a printing machine, wherein the sheet is brought to a transport speed, for transfer to another transport path, the method comprising the steps of:

initially accelerating the sheet to a speed that is greater than a desired transport speed and, after a phase of this higher speed, slowing said sheet to the desired transport speed, wherein the phase of the higher speed is dimensioned such that an affected sheet is in a nominal position at an appropriate time wherein a progression of acceleration during the acceleration of said sheet takes place as a function of $\sin^x t$, wherein t is time and where the exponent x is a number greater than or equal to 1 and smaller than or equal to 4.

2. Method as in claim 1, wherein the exponent x is approximately equal to 2.

3. Method as in claim 1, wherein a progression of speed is electronically controlled.

4. Method as in claim 1, further comprising detecting a position of a lead edge of the sheet with a lead edge sensor, comparing a position of the sheet with a pre-specified desired position based on said detection step, and using said comparison, determining a length of the phase of higher speed.

5. Method as in claim 4, wherein the lead edge of the sheet is detected during the phase of higher speed.

6. A device for transporting a sheet, picking the sheet off of a stack and separating the sheet from said stack, the device comprising at least one transport element adapted to bring the sheet to a transport speed wherein the transport element can be driven in such a manner that the sheet can initially be accelerated to a higher speed that is greater than the transport speed and after a phase of the higher speed, said sheet can be slowed to the transport speed, wherein the phase of the higher speed can be dimensioned such that an affected sheet is in a nominal position at an appropriate time, and wherein a progression of said initial acceleration takes place as a function of $\sin^x t$ where t is time and where the exponent x is a number greater than or equal to about 1 and smaller than or equal to about 4.

7. Device as in claim 6, wherein a picker motor is provided for driving the transport element.

8. Device as in claim 7, wherein the picker motor is a stepper motor.

9. Device as in claim 7, wherein, for completion of the phase at the higher speed, at most one path segment is provided between feed rolls of the picker motor, said rolls acting as transport elements, and the closest subsequent pair of transport rolls on a transport path.

10. Device as in claim 9, wherein the path segment measures approximately 10 centimeters.

11. Device as in claim 9, further comprising a lead edge sensor for the detection of a position of a lead edge of the sheet.

12. Device as in claim 11, wherein the lead edge sensor is located at a start of said path segment.

13. Device as in claim 6, wherein the exponent x is equal to about 2.

* * * * *